US007367079B2

(12) United States Patent
Schwade et al.

(10) Patent No.: US 7,367,079 B2
(45) Date of Patent: May 6, 2008

(54) INTEGRAL PACKING HOUSING AND PACKING MATERIAL UNIT

(75) Inventors: Hans Schwade, Atlanta, GA (US); Bruce Townsend, Flowery Branch, GA (US); Michael W. Stewart, Snellville, GA (US)

(73) Assignee: Clyde Bergemann, Inc., Atlanta, GA (US)

( * ) Notice: Subject to any disclaimer, the term of this patent is extended or adjusted under 35 U.S.C. 154(b) by 650 days.

(21) Appl. No.: 10/612,195

(22) Filed: Jul. 2, 2003

(65) Prior Publication Data

US 2004/0019999 A1 Feb. 5, 2004

Related U.S. Application Data

(60) Provisional application No. 60/394,495, filed on Jul. 9, 2002.

(51) Int. Cl.
*A47L 5/38* (2006.01)

(52) U.S. Cl. ..... 15/315; 122/379; 122/380

(58) Field of Classification Search ..... None
See application file for complete search history.

(56) References Cited

U.S. PATENT DOCUMENTS

| | | | | |
|---|---|---|---|---|
| 395,968 | A | 1/1889 | Franke | |
| 4,924,817 | A | 5/1990 | Seelen | |
| 5,090,087 | A * | 2/1992 | Hipple et al. | 15/317 |
| 5,549,305 | A | 8/1996 | Freund | |

FOREIGN PATENT DOCUMENTS

| | | |
|---|---|---|
| DE | 575698 | 5/1933 |
| DE | 919501 | 7/1949 |
| DE | 1451535 | 2/1969 |
| DE | 1526139 | 12/1971 |
| DE | 3106421 | 11/1982 |
| DE | 1176785 | 1/2002 |
| EP | 0763702 | 3/1997 |
| FR | 1430776 | 4/1965 |

* cited by examiner

*Primary Examiner*—David A Redding
(74) *Attorney, Agent, or Firm*—Michael J. Mehrman; Mehrman Law Office PC

(57) ABSTRACT

An integral packing housing and packing material unit; a method for packing replacement, boiler cleaning; and a method for maintenance of a desired boiler output rating. The integral packing unit includes a housing for removably holding a sacrificial packing material that is configured to form a steam seal between a sootblower steam tube and lance spindle when the packing unit is installed in an operative position in association with the steam tube and the spindle and the packing material is loaded by applying compression to the packing material. A compression unit is typically coupled to the housing unit to apply such compression to load the packing material while the packing unit is installed in the operative position. The packing unit may also includes a detent mechanism, such set screws, for unloading the packing material to facilitate installing the packing unit on, and removing the packing unit from, the operative position.

24 Claims, 19 Drawing Sheets

INTEGRAL PACKING HOUSING AND PACKING MATERIAL UNIT

REFERENCE TO RELATED APPLICATIONS

This application claims priority to commonly-owned U.S. Provisional Patent Application Ser. No. 60/394,495, entitled "Soot Blower Packing," filed on Jul. 9, 2002.

TECHNICAL FIELD

The present invention relates to sootblowers used to clean industrial boilers and, more particularly, relates to an integral packing and packing housing unit that makes it faster, easier and safer to replace the sacrificial packing used to seal the steam joint in industrial sootblowers.

BACKGROUND OF THE INVENTION

Industrial boilers, such as oil-fired, coal-fired and trash-fired boilers in power plants used for electricity generation and waste incineration, as well as boilers used in paper manufacturing, oil refining, steel and aluminum smelting and other industrial enterprises, are huge structures that generate tons of ash while operating at very high combustion temperatures. These boilers are generally characterized by an enormous open furnace in a lower section of the boiler housed within walls constructed from heat exchanger tubes that carry pressurized water, which is heated by the furnace. An ash collection and disposal section is typically located below the furnace, which collects the ash and carts it away for disposal, typically using a hopper and a conveyor or rail car.

There is a high demand for thermal energy produced by these large industrial boilers, and they exhibit a high cost associated with shutting down and subsequently bringing the boilers back up to operating temperatures. For these reasons, the boilers preferably run continuously for long periods of time, such as months, between shut down periods. This means that large amounts of ash, which is continuously generated by the boiler, must be removed while the boiler remains in operation. Further, fly ash tends to adhere and solidify into slag that accumulates on high-temperature interior boiler structures, including the furnace walls, the superheater platens, and the other heat exchangers of the boiler. If the slag is not effectively removed while the boiler remains in operation, it can accumulate to such an extent that it significantly reduces the heat transfer capability of the boiler, which reduces the thermal output and economic value of the boiler. In addition, large unchecked accumulations of slag can cause huge chunks of slag to break loose, particularly from the platens, which fall through the boiler and can cause catastrophic damage and failure of the boiler. The slag accumulation problem in many conventional boilers has been exacerbated in recent years by increasingly stringent air quality standards, which have mandated a change to coal with a lower sulphur content. This low-sulphur coal has a higher ash content and produces more tenacious slag deposits that accumulate more quickly and are more difficult to remove, particularly from the superheater platens.

To combat this problem, the industry has developed increasingly sophisticated boiler cleaning equipment. In particular, steam and multi-media (e.g., water and steam) sootblowers have been developed for periodically cleaning the heat exchangers while the boiler remains in operation. These sootblowers generally include lance tubes that are inserted into the boiler adjacent to the heat exchangers and operate like large pressure washers to clean the heat exchangers with a cleaning fluid, such as water, steam, or both water and steam, while the boiler remains in operation. These sootblowers are generally characterized by rotating and linearly traveling lance tubes that blast the cleaning fluid in a corkscrew pattern to clean as wide an area as possible as the lance advances. To allow the lance tube to move freely while transporting the steam, the lance tube is typically received telescopically over an open steam tube. This allows the steam tube to deliver steam into an interior cavity of the lance tube as the lance rotates and moves telescopically on the steam tube.

The configuration described above creates moving steam joint between the steam tube and the lance that must remain sealed as the lance rotates and moves telescopically along the steam tube. This steam joint is typically sealed by a set of sacrificial gaskets known as a "packing," which consisting of a series of rings constructed from a deformable, heat-resistant material, such as an oil impregnated graphite material known in the trade as GRAPHOIL™. TEFLON™ based materials have also been successfully used for sootblower packing.

The packing rings have an inner diameter approximately the size of the steam tube and an outer diameter approximately the size of the inner dimension of a spindle surrounding the packing. The spindle, in turn, supports the lance as the lance rotates and moves linearly along the steam tube. To form a seal, the packing is loaded by a compression plate that is typically biased by spring washers (also called "Belleville washers"). Compression presses the packing material against the spindle and steam tube and thereby causes the packing to deform sufficiently to form a steam-tight seal. The spring washers expand over time to maintain the load on the packing as friction wears away sacrificial packing material. Eventually, the packing becomes spent and must be replaced.

The packing is replaced by sliding the steam tube out the spindle and then picking, prying and scraping the spent packing material out of the spindle. This packing, which has been mashed an repeatedly heated and cooled over time, can be difficult to coax out of the spindle. For this reason, technicians have been known to resort to non-recommended packing removal methods, such as opening the steam valve adjacent to the packing in an attempt to blow the packing out of the spindle. It should be appreciated that the sootblowers are typically used continually every day (e.g., hourly) while the boiler is in operation. For this reason, an extended packing replacement process, as occurs when technicians grapple with picking and scraping jammed packing out of the spindle, can interfere with the boiler cleaning regimen.

Accordingly, a continuing need exists for improved packing and packing replacement procedures for sootblowers used to periodically clean industrial boilers. More specifically, a need exists for a sootblower packing that lasts longer and can be removed and replaced faster, easier and more safely than a conventional sootblower packing.

SUMMARY OF THE INVENTION

The present invention meets the needs described above in an integral packing unit including a housing and packing material that makes it faster, easier and safer to replace the sacrificial packing used to seal the steam joint between the steam tube and lance in industrial sootblowers. The integral packing unit allows the packing material, which is typically designed to be sacrificial, to be replaced by removing the entire packing unit intact from the spindle. The packing unit can then be disassembled on a workbench or other suitable work area, where the spent packing material is removed and a new packing is installed. The packing unit is then reassembled and installed intact on the sootblower. For example, the packing unit may include a cylindrical packing housing configured to receive a number sacrificial packing rings, which are replaced from time to time as the packing rings wear away.

The packing unit works with a compression unit that may be integral with or separable from the housing. The compression unit typically includes a system of coil springs to load the packing rings evenly and over a greater linear travel distance of the compression plate than is possible with spring washers. To facilitate removal of the packing unit for packing ring replacement, the compression unit typically includes a detent mechanism, such as a pair of set screws that can be screwed into the compression unit into an active position to relieve the load on the packing. Once the set screws have been installed to relieve the load on the packing material, the compression unit may be removed from the sootblower. The packing housing holding the spent packing material can then be easily removed for packing replacement. The packing unit is then reassembled and installed intact on the sootblower, the compression unit is reinstalled, and the detent mechanism is deactivated to load the packing. If the packing housing is integral with or connected to the compression unit, the packing material, packing housing and compression unit may be removed and reinstalled as an integral unit. The packing unit also typically includes a packing wear monitor, such as a viewing port revealing the linear travel position of the compression unit, which allows a technician to easily determine when the packing rings require replacement.

Generally described, the invention may be implemented as an integral and removable packing unit that includes a housing for removably holding a sacrificial packing material. This packing material is configured to form a steam seal between a sootblower steam tube and lance spindle when the packing unit is installed in an operative position and the packing material is loaded through compression. A compression unit is typically coupled to the housing unit to apply such compression to load the packing material while the packing unit is installed in the operative position. The compression unit may also include a detent mechanism, such as one or more set screws, for unloading the packing material to facilitate installing the packing unit intact on, and removing the packing unit intact from, the operative position.

More specifically, the packing material typically includes a series of equally-sized, concentric, sacrificial packing rings having an inner dimension approximately equal to an outer dimension of the steam tube and an outer dimension approximately equal to an inner dimension of the packing unit housing. In addition, the packing unit ordinarily defines a cylindrical opening for receiving the steam tube, and the compression unit typically includes one or more coil springs located between first and second compression plates. This allows the packing material to be captured on the steam tube and compressed by the compression unit when the packing unit is in the operative position and the detent mechanism is inactive.

In a particular configuration, the compression unit includes eight compression springs located around the cylindrical opening surrounding the steam tube. In this embodiment, the set screws threadably engage at least one of the compression plates to compress the coil springs and thereby unload the packing material. The packing unit may also include a packing wear monitor, such as a viewing port revealing the linear travel position of the second compression plate.

The invention also includes a sootblower including a lance tube telescopically received on a steam tube and an integral packing housing, a packing material and packing compression unit, as described above. The packing material may be sacrificial, and the packing unit may include a packing wear monitor to gauge the extent of depletion of the sacrificial packing material. This configuration represents an improvement in sootblower design including an integral packing unit that can be removed and reinstalled intact for the purpose of replacing the packing material. The invention also includes an industrial boiler having a cleaning system including a plurality of the sootblowers with integral packing units, and a power plant having an output rating maintained by a boiler cleaning system including a number of sootblowers with integral packing units.

The invention also includes a method for replacing the packing material in an integral packing housing, packing material and packing compression unit for an industrial sootblower. A detent mechanism is activated to unload the packing material while the packing unit is installed in an operative position on the sootblower. The packing unit is then removed intact from the sootblower. The spent packing material is then removed and new packing material is installed in the packing unit, typically at a workbench or other suitable work location. The packing unit with the new packing material is then reinstalled intact in the operative position on the sootblower, and the detent mechanism is deactivated to load the packing material. This packing replacement method also supports a method for maintaining a desired output rating for an industrial boiler by continually cleaning the boiler with sootblowers while the boiler is in operation, and by periodically maintaining the sootblowers with packing replacement using the packing replacement method described above.

In view of the foregoing, it will be appreciated that the present invention avoids the drawbacks of prior packing systems for industrial sootblowers by providing an integral packing unit that makes it safer, faster and easier to replace the spent packing material. The invention also provides an improved method for packing replacement, boiler cleaning, and maintenance of a desired boiler output rating. The specific techniques and structures for implementing the invention, and thereby accomplishing the advantages described above, will become apparent from the following detailed description of the illustrative embodiments of the invention and the appended drawings and claims.

DETAILED DESCRIPTION OF EXEMPLARY EMBODIMENTS

Figure 1:
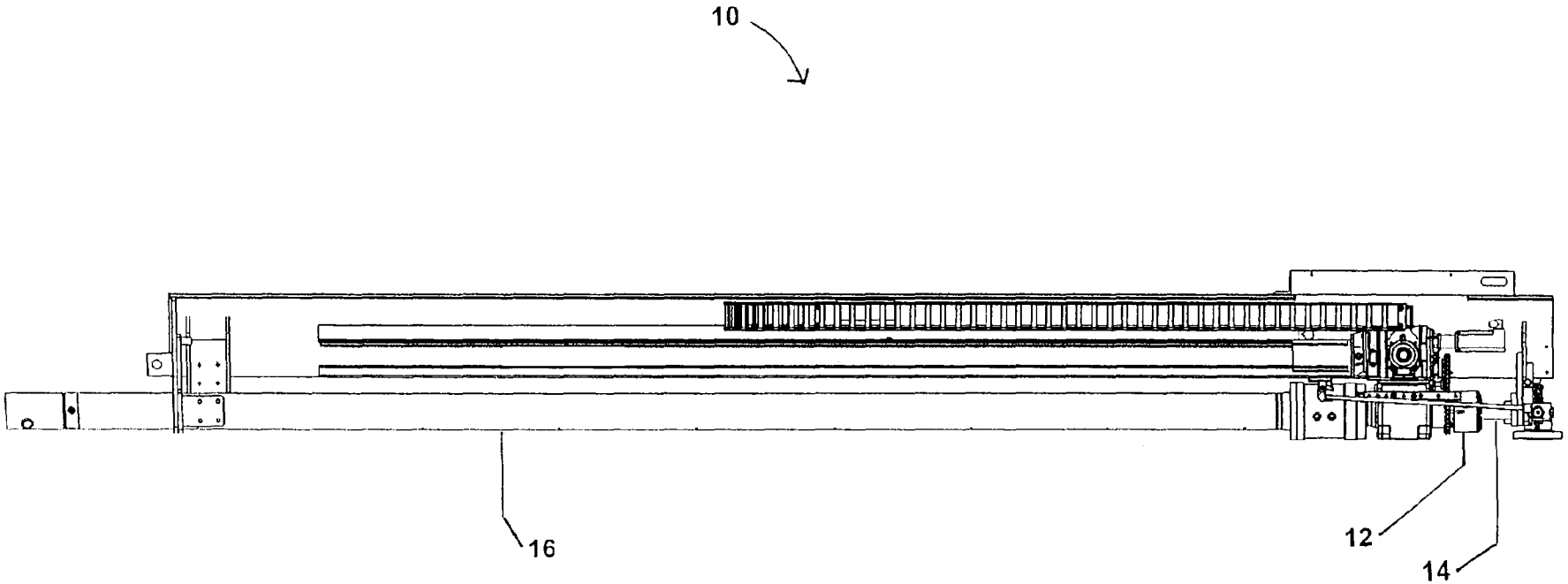
FIG. 1 is a side view of a sootblower including an integral packing unit shown in a fully retracted position.

The present invention relates to industrial sootblowers and associated boiler cleaning equipment. In general, the integral packing and packing housing unit described below may be employed with any type of sootblower, but is particularly well adapted to sootblowers that use steam as a cleaning fluid. The illustrative sootblower described below selectively applies two cleaning fluids, typically water and steam, which may be applied individually or in combination during a cleaning operation. However, the principles realized by the exemplary embodiments of the invention as described in this specification may be directly modified and extrapolated to develop sootblowers capable of applying more than two independently controlled cleaning fluids, having more then two independently controlled systems for applying any particular cleaning fluid, and for applying different types of cleaning fluids, such as air, solvents, sand blast streams, bead blast streams, liquid nitrogen or other very cold fluids, superheated plasma or other very hot fluids, or any other cleaning fluid that may be appropriate for a particular application. It should also be appreciated that the sootblower may be used for purposes other than cleaning, such as applying paint, sealant, or other desired coatings to interior boiler components.

The exemplary sootblower described below also includes two independently controlled water application systems that each include two nozzles. Of course, the number of independently controlled water systems, and the number of nozzles included in each water application system, are design choices that may be altered to meet the objectives of a particular application. Similarly, the exemplary sootblower includes a single steam application system with two nozzles, but additional steam systems and different numbers of steam nozzles may be included, as desired, for particular applications.

The particular multi-media rotating sootblower and associated automatic boiler cleaning system described below are well adapted for use in large-scale coal-fired, oil-fired and trash-fired boilers that are typically used to generate electric power and heat or process steam for industrial enterprises, such as electricity generation, paper manufacturing and municipal incineration. Nevertheless, it should be understood that these or modified sootblowers may also be used in other types of industrial boilers, such as wood, straw, peat and manure-fired boilers, as well as heat recovery boilers commonly used in steel and aluminum smelters, chemical manufacturing, oil refineries, and other industrial processes. Basically, all industrial boilers can benefit from effective cleaning, and a variation of the multi-media rotating sootblower described below may be readily adapted to any particular industrial boiler configuration and cleaning requirement.

It should also be understood that many design modifications and additions may be readily deployed with specific embodiment described below, such as independently articulating and controlled nozzles, articulating lances (which are described as rotating and linearly traveling, but not otherwise articulating), pulsating cleaning fluid streams, varying pressure cleaning fluid streams, alternating cleaning media fluid streams, and so forth. However, each of these modifications would add cost and complexity to the system. Therefore, it should also be appreciated that the preferred embodiments described below are presently considered by the inventors to embody the most technically and economically feasible sootblowers and automatic cleaning systems for today's industrial boilers, and in particular the boilers found in oil-fired, coal-fired and trash-fired boilers in power plants used for electricity generation and waste incineration, as well as boilers used in paper manufacturing, oil refining, steel and aluminum smelting.

The illustrative embodiment of the integral packing unit described below is configured to work with a compression unit including eight coil springs located between and around the perimeter of a pair of compression plates. However, other spring arrangements could be employed, such as a single coil spring that receives the steam tube through its center, or a different number of or configuration of coil springs or other types of springs, such as spring washers, leaf springs, expandable blocks (e.g., rubber), ball screws, electrically activated expanding materials, and the like. In addition, loading mechanisms other than springs may be employed, such as air cylinders, air bags, hydraulic cylinders, ratchet assemblies, and the like.

Further, the packing material need not be sacrificial and need not be configured in the form of equally-sized, concentric rings. For example, the packing material may be a solid cylinder or another shape suitable for a particular application, and may use a technique other than a deformable sacrificial gasket to for a seal, such as an air flow, fluid flow, magnetic barrier, or other type extruded of induced barrier. Similarly, detent mechanisms other than set screws may be employed, such as levers, ratchets, cams, air cylinders, hydraulic cylinders, air bags, ball screws, and the like. In addition, the packing unit may be deployed without a detent mechanism, in which case the unit would have to be disassembled and reassembled in-place on the sootblower to replace the packing.

In addition, the packing unit is typically coupled to the compression unit, either removably or as an integral unit.

For example, the compression unit and the packing housing may be formed of a continuous material or welded together, or they may be held together by bolts, pins, retention clips, or any other suitable connection device. In any case, the compression unit is typically attached directly to packing housing in some manner to facilitate easy installation and removal of the assembly. However, it should be appreciated that the compression unit need not be attached directly to the packing unit housing, and could be supported by another structure, such as the steam tube, lance, spindle, frame or other suitable supporting structure.

It should also be appreciated that the preferred configuration described below is presently considered by the inventors to be the best and most cost effective way to implement an integral packing unit for conventional industrial sootblowers, and that any significant variation from the preferred configuration would likely add cost and complexity the system. However, it is also evident that those skilled in the art will recognize that many variations to the preferred configuration, such as those described above as well as many routine design choice, may be employed to accomplish the principles and achieve the advantages illustrated by specific embodiment described below. In addition, a similar packing unit may also find use in devices other than industrial sootblowers, such as paint sprayers, solvent sprayers, sand blasters, and so forth.

Turning now to the figures, in which similar reference numerals indicate similar elements in the several figures, FIG. 1 is sootblower 10 including an integral packing unit 12 shown in a fully retracted position. A typical sootblower 10 suitable for using the integral packing unit 12 is described in commonly-owned U.S. Pat. No. 6,892,679, entitled "Multi-Media Rotating Sootblower and Automatic Industrial Boiler Cleaning System," filed contemporaneously with the present application, which is incorporated herein by reference. Those skilled in the art will recognize that other types of sootblowers requiring steam or similar seals may also use the integral packing unit 12 or a variation of this device.

Figure 2:
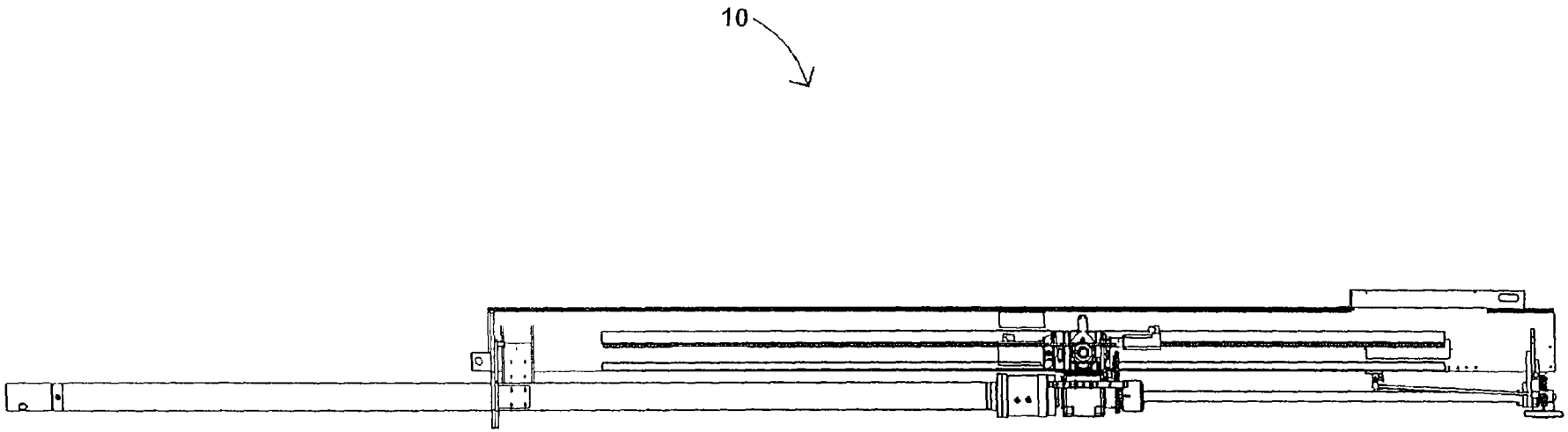
FIG. 2 is a side view of the sootblower in a partially extended position.
Figure 3:
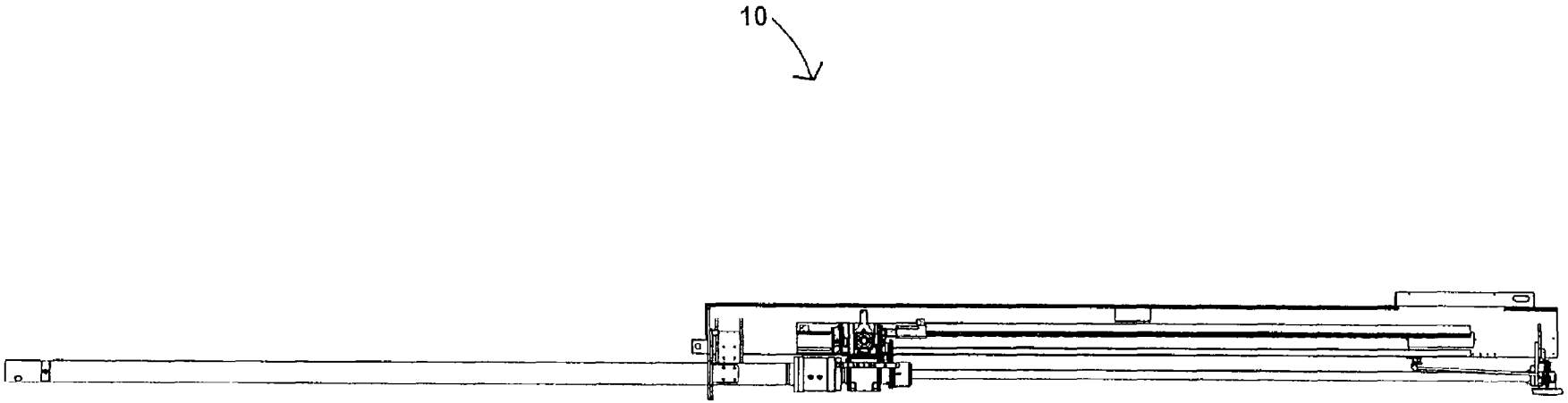
FIG. 3 is a side view of the sootblower in a fully extended position.

In general, the sootblower 10 includes a steam tube 14 and a lance tube 16 that rotates and moves telescopically on the steam tube to enter and clean internal components of an industrial boiler. The steam tube 14 delivers steam into an internal chamber within the lance tube 16, which is in fluid communications with one or more steam jets located in an nozzle at the end of the lance tube. The steam jets, in turn, blast the steam to act as a large industrial pressure washer to clean the internal components of the boiler. This is illustrated by FIG. 2 showing the sootblower 10 in a partially extended position, and FIG. 3 showing the sootblower 10 in a fully extended position. The lance tube 16 also rotates as it moves telescopically along the steam tube 14 to blast cleaning fluids, typically including water, steam, or a combination of water and steam, in a corkscrew pattern.

Figure 4:
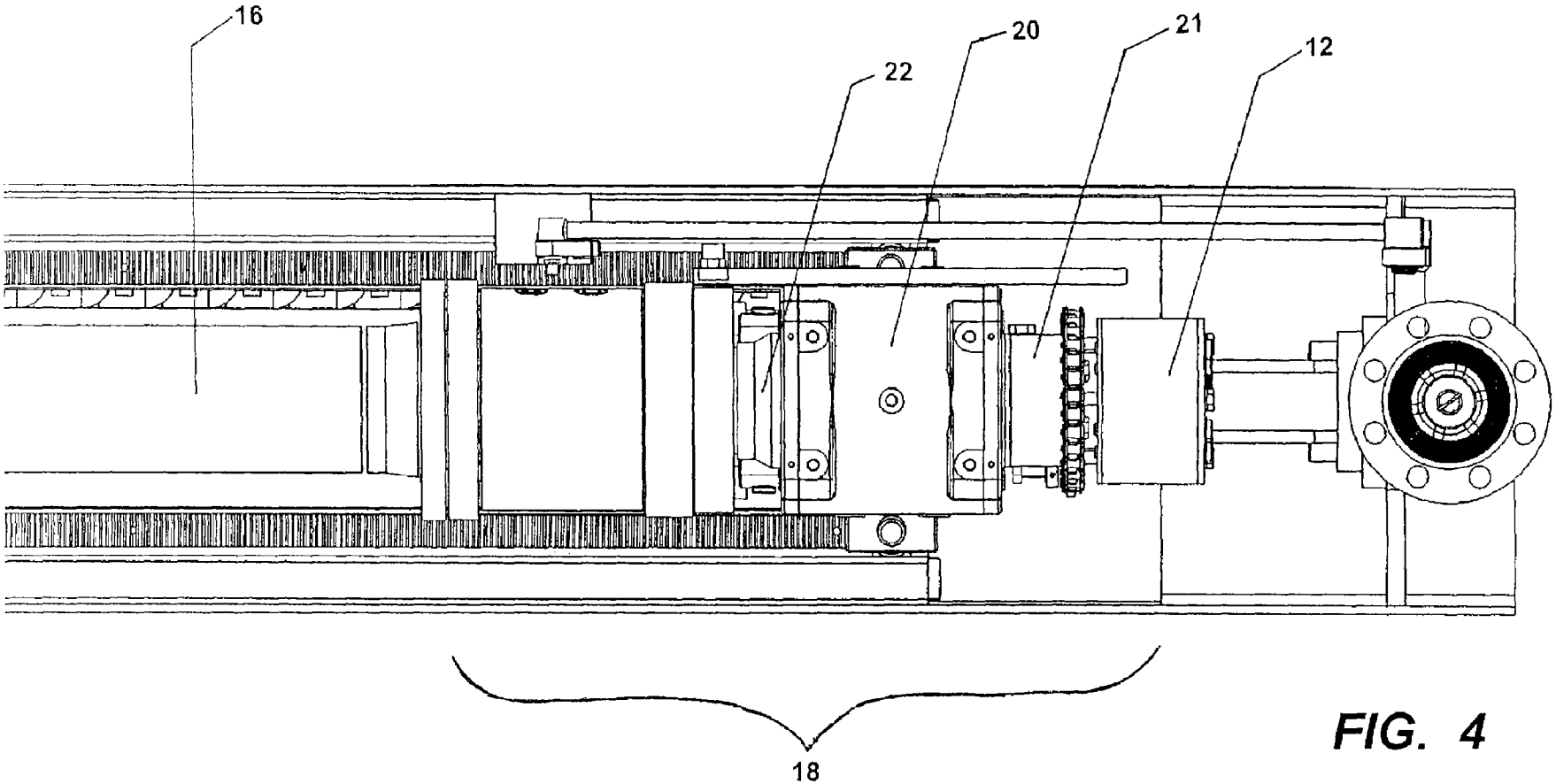
FIG. 4 is a bottom view of a sootblower carriage showing an integral packing unit installed for operation.
Figure 5:
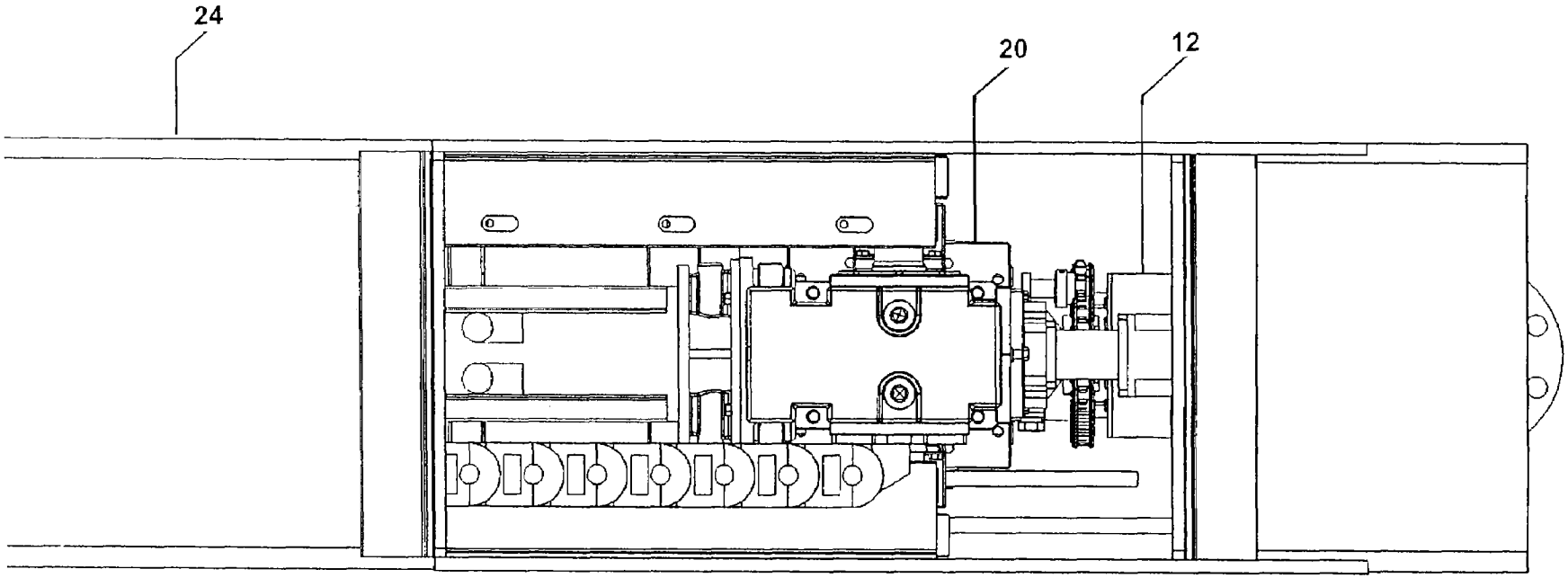
FIG. 5 is a top view of the sootblower carriage of FIG. 5.

The purpose of the integral packing unit 12 is to form a steam-tight seal between the steam tube 14 and the lance 16 as the lance rotates and moves telescopically on the steam tube. It is therefore located between the steam tube 14 and a spindle 21 (see FIG. 4) that rotates and moves linearly with the lance 16. FIG. 4 is a bottom view of the carriage, 18 of the sootblower 10, which shows the integral packing unit 12 installed in its operative position. The packing unit 12 surrounds the steam tube 14, which passes through a cylindrical opening defined by the packing unit, and fits into an opening in the spindle 21, which is located within a spindle housing 20. A flange 22 extending form the spindle 21 is also visible in FIG. 4. FIG. 5 is a top view of the carriage 18 of the sootblower 10. In this view, the lance and steam tube are obscured by the frame or canopy 24, which supports the sootblower 10. The sootblower 10 also includes an appropriate gasket between the packing unit 12 and the spindle 21. For example, a copper gasket performs well in this application.

Figure 6:
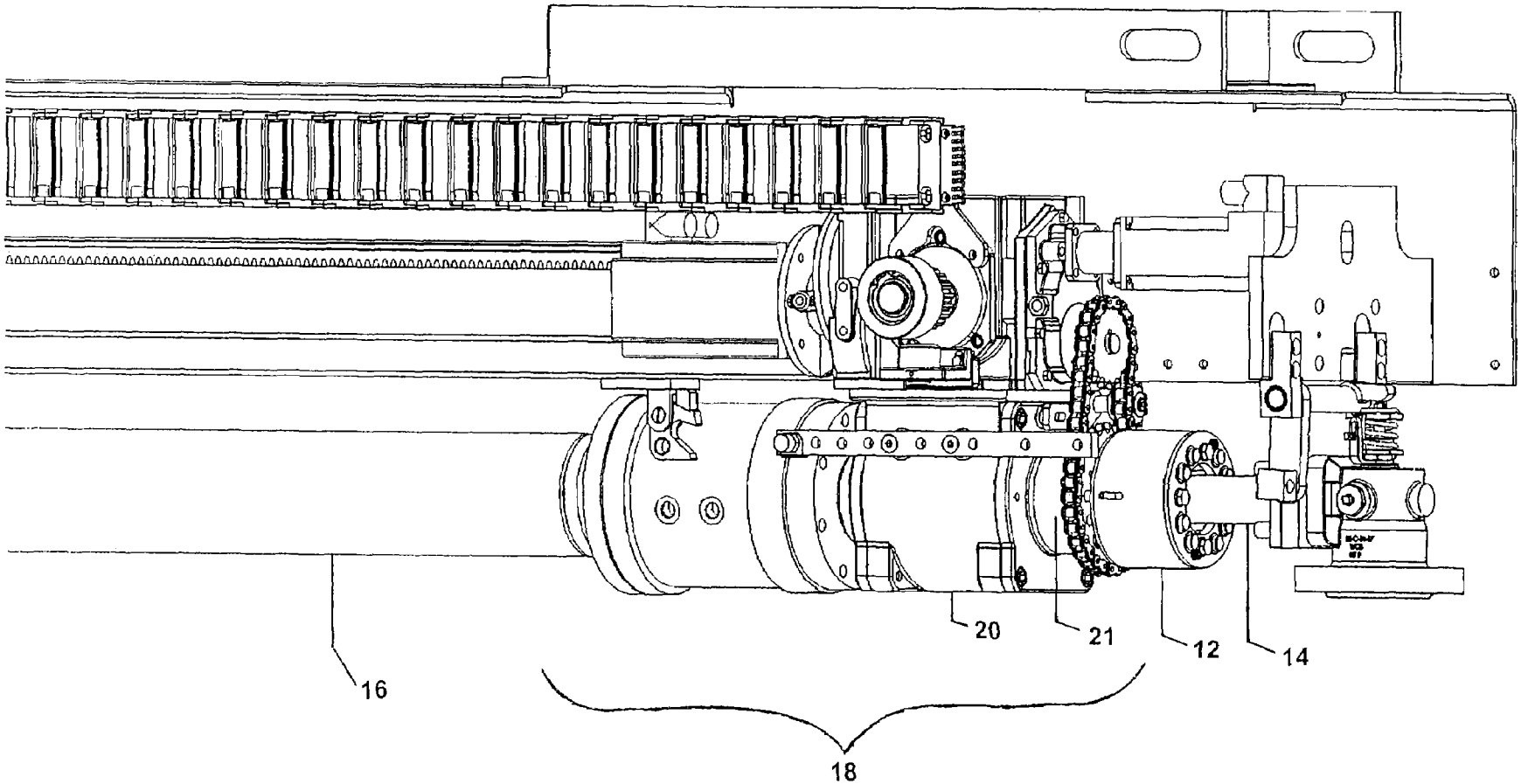
FIG. 6 is a side perspective view of the sootblower carriage of FIG. 5.
Figure 7:
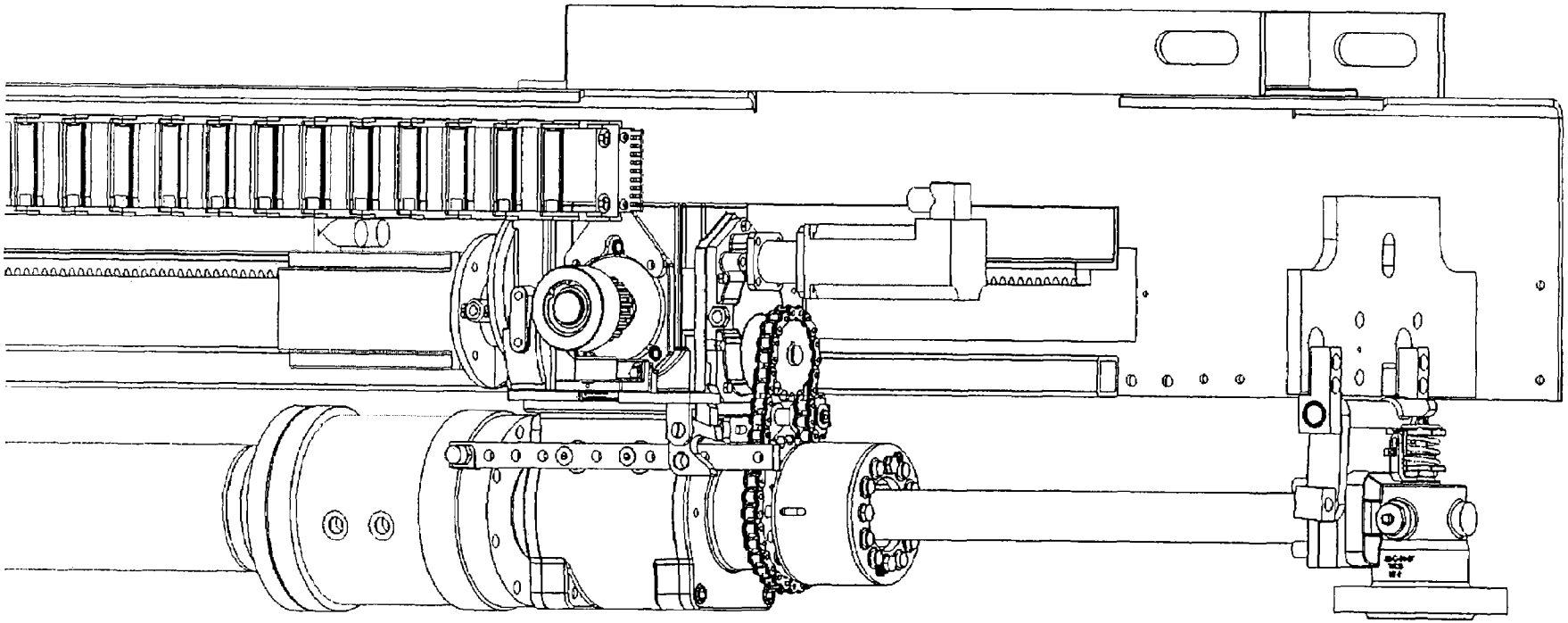
FIG. 7 is a side perspective view of the sootblower carriage of FIG. 5 with the set screws installed in the packing unit and the carriage advanced slightly for packing unit removal.
Figure 8:
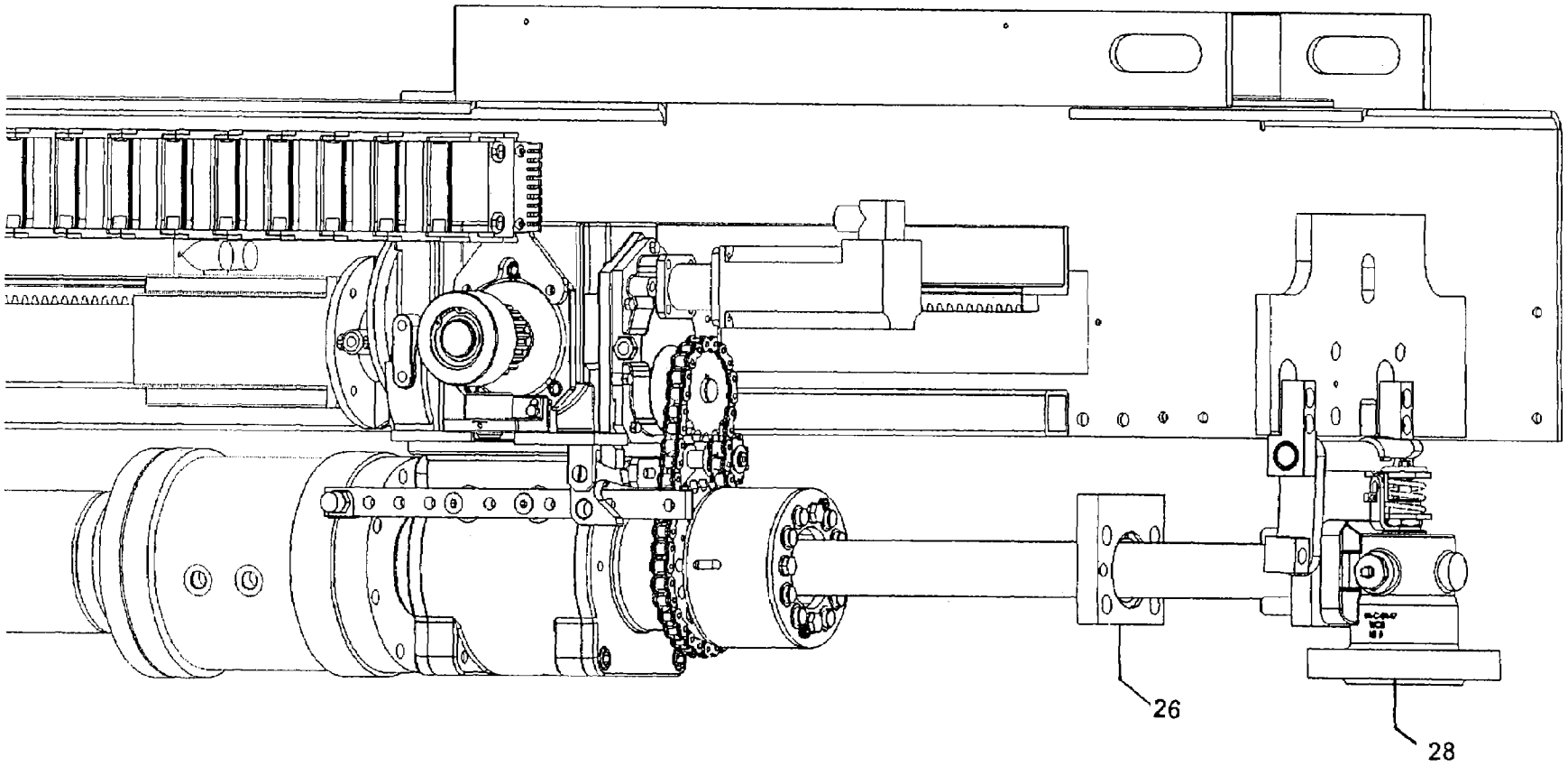
FIG. 8 is a side perspective view of the sootblower carriage of FIG. 5 with a steam tube connection plate removed in the packing unit removal process.
Figure 9:
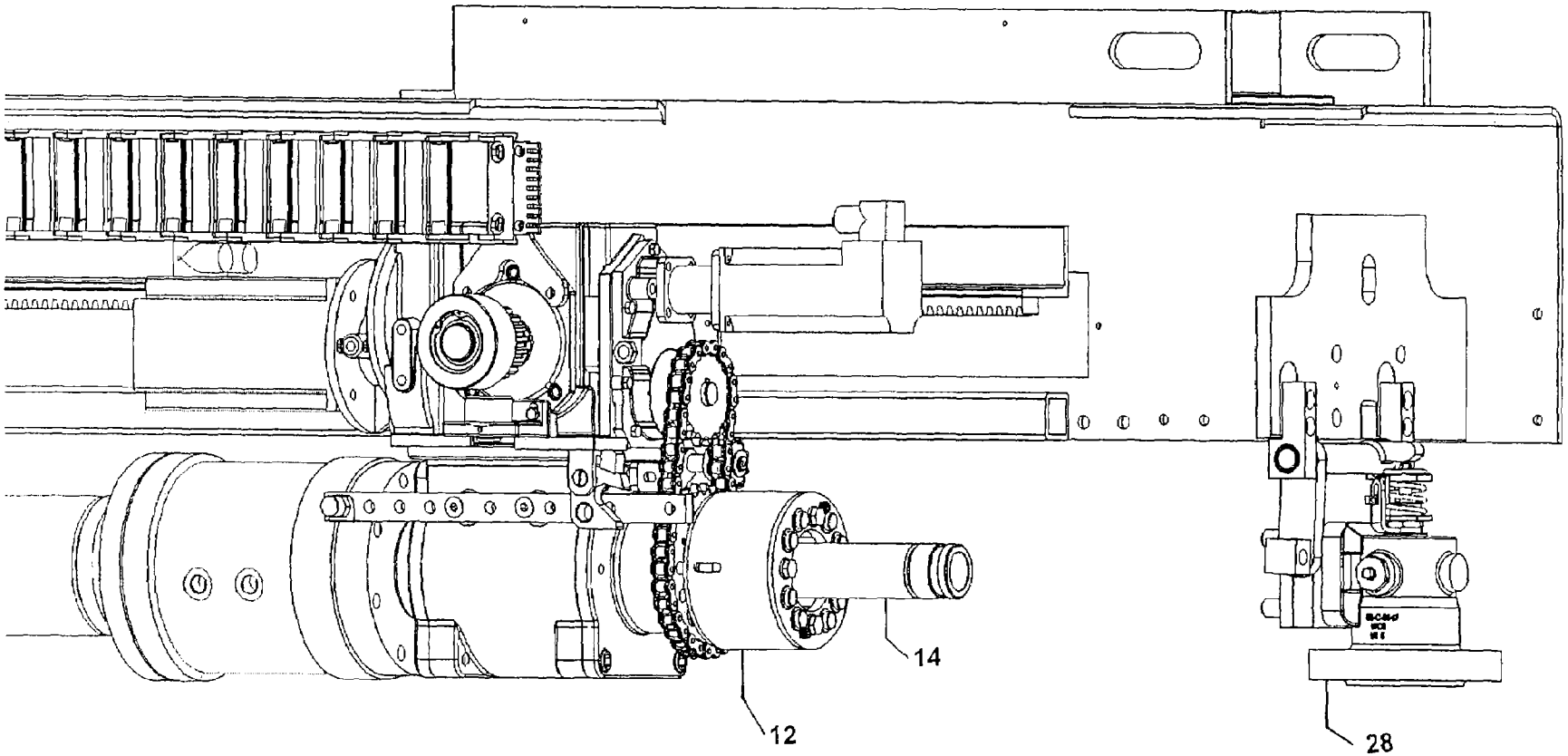
FIG. 9 is a side perspective view of the sootblower carriage of FIG. 5 with the steam tube advanced in the packing unit removal process.

FIG. 6 is a side perspective view of the carriage 18 of the sootblower 10, which shows the packing unit 12 installed in its operable position. To remove the packing unit 12 and replace the spent packing, the carriage 18 is moved slightly forward on the steam tube 14, as shown in FIG. 7. Bolts holding a steam tube connection plate 26 in place against the steam valve 28 are then removed, and the connection plate is pulled away from the steam valve, as shown in FIG. 8. The steam tube 14 is then pulled away from the steam valve 28, which creates an opening for removing the packing unit 12 intact from the sootblower 10.

Figure 10:
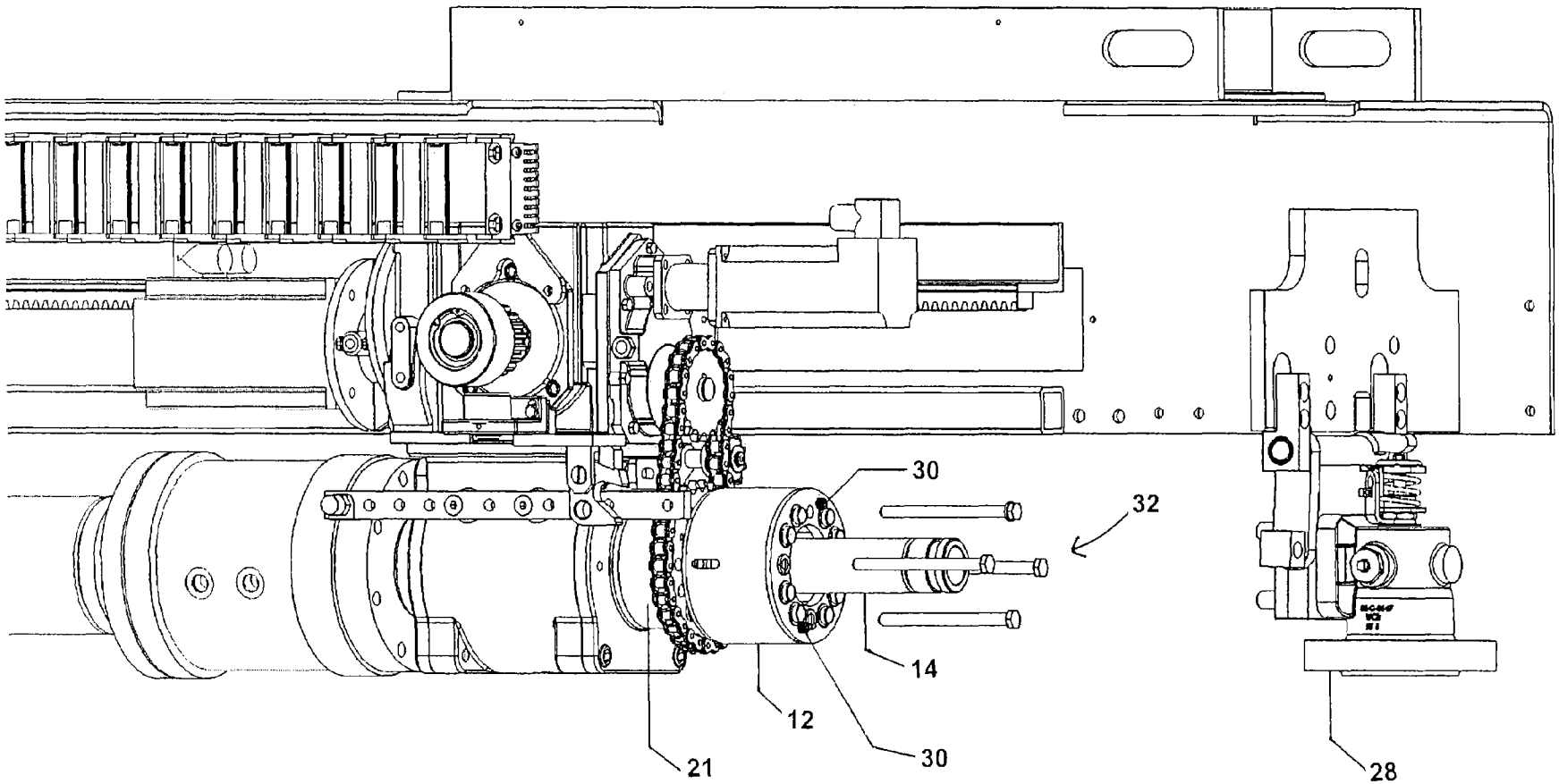
FIG. 10 is a side perspective view of the sootblower carriage of FIG. 5 with the packing unit retention bolts removed in the packing unit removal process.
Figure 11:
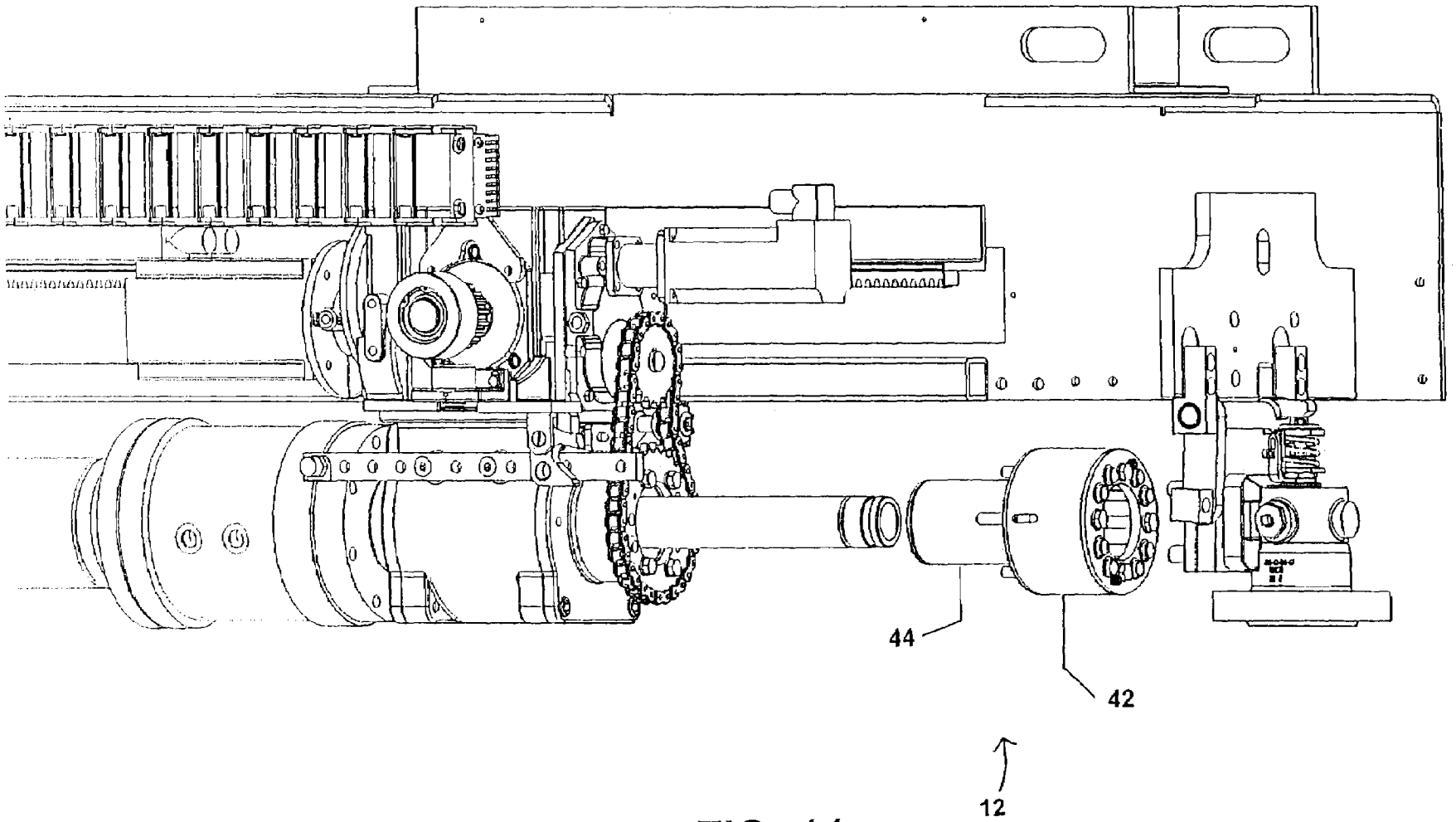
FIG. 11 is a side perspective view of the sootblower carriage of FIG. 5 with the packing unit removed for packing ring replacement.

As shown in FIG. 10, the set screws 30 are screwed in to the packing unit 12 sufficiently to unload the packing, and the retention bolts 32 that hold the packing unit to the spindle 21 are removed. This allows the packing unit 12 to be removed intact from the sootblower 10, as shown in FIG. 11. The packing unit 12 typically includes a compression unit 42 (see FIG. 12) and an packing housing 44, which may be integral or separable from each other. If they are separable, the compression unit 42 may be removed first, and the compression unit 44 with the packing material inside may be removed after the compression unit. However, it will usually be faster and easier to remove the entire packing unit 12 intact as shown in FIG. 11, which is then removed to a workbench or other suitable work area for disassembly and packing replacement.

Figure 12:
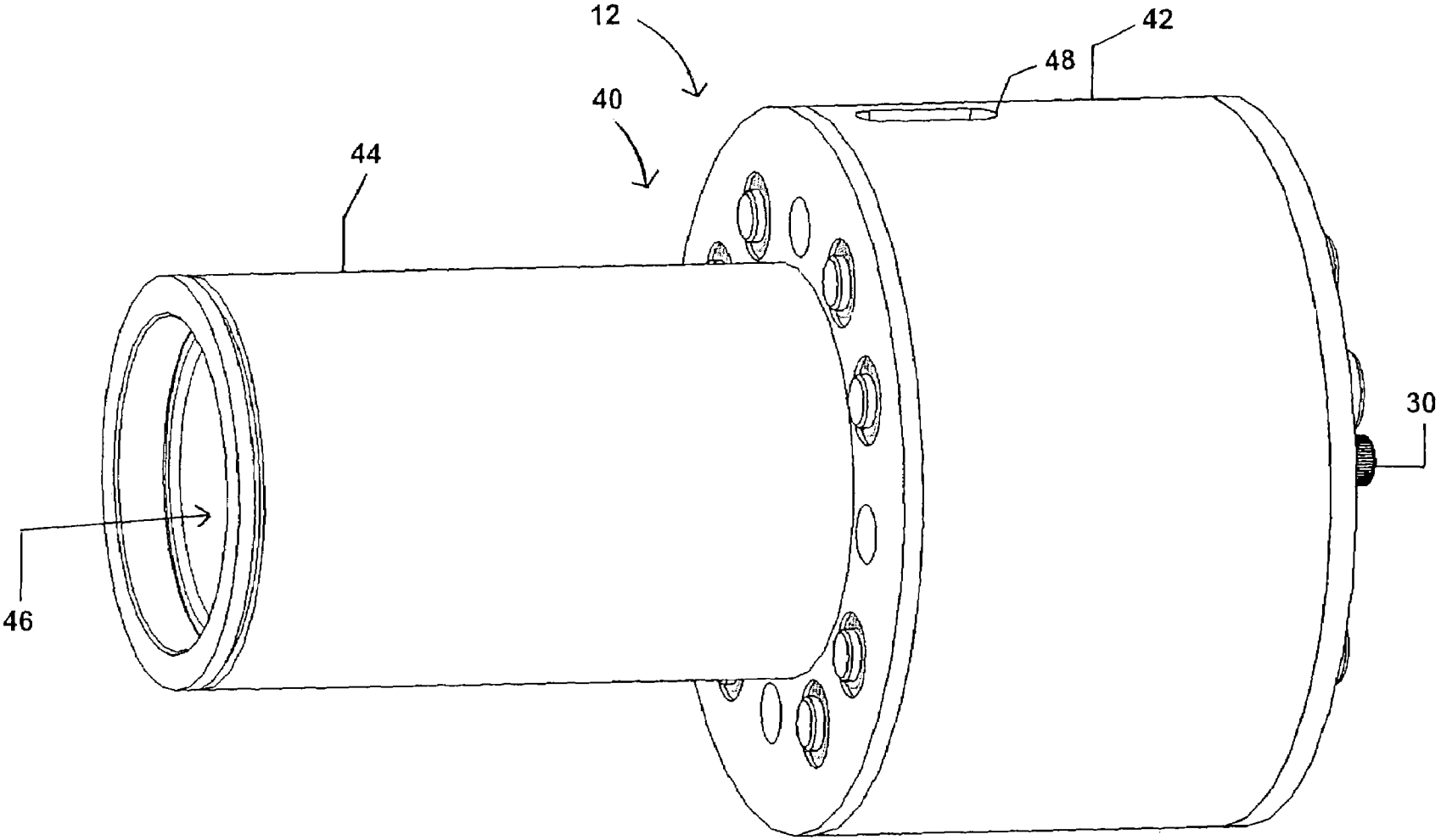
FIG. 12 is a side perspective view of an integral packing unit.

FIG. 12 is a side perspective view of the integral packing unit 12. The outer housing 40 is visible in this view, which includes a relatively large cylinder containing the compression unit 42 connected to a smaller cylinder 44 that defines the packing housing 44. The packing material is located within the packing housing 44, as shown in subsequent figures. These cylinders are arranged end-to-end about a common longitudinal axis to define a cylindrical opening 46 for receiving the steam tube 14, as shown in FIGS. 1-11. The smaller cylinder 44 may be integral with the larger cylinder 42 (e.g., welded together) or they may be separable. For example, the smaller cylinder 44 may threadably engage the larger cylinder 42, or they may be held together by bolts, pins, retention clips, or any other suitable connection device. That is, the compression unit 42 is typically attached directly to the packing housing 44 in some manner to facilitate easy installation and removal of the assembly.

Figure 13:
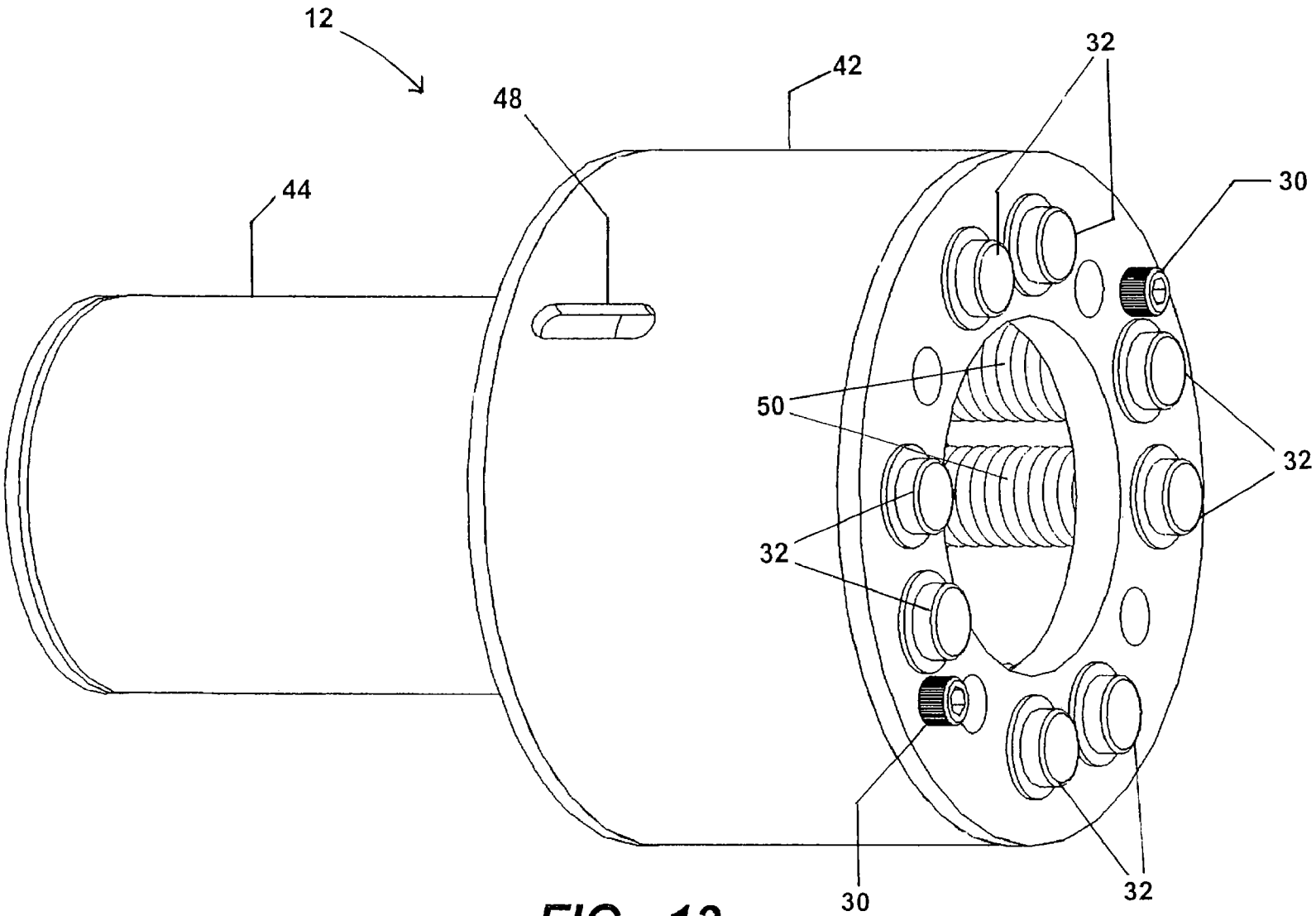
FIG. 13 is a side perspective view of the integral packing unit of FIG. 12 shown from a different perspective.
Figure 14:
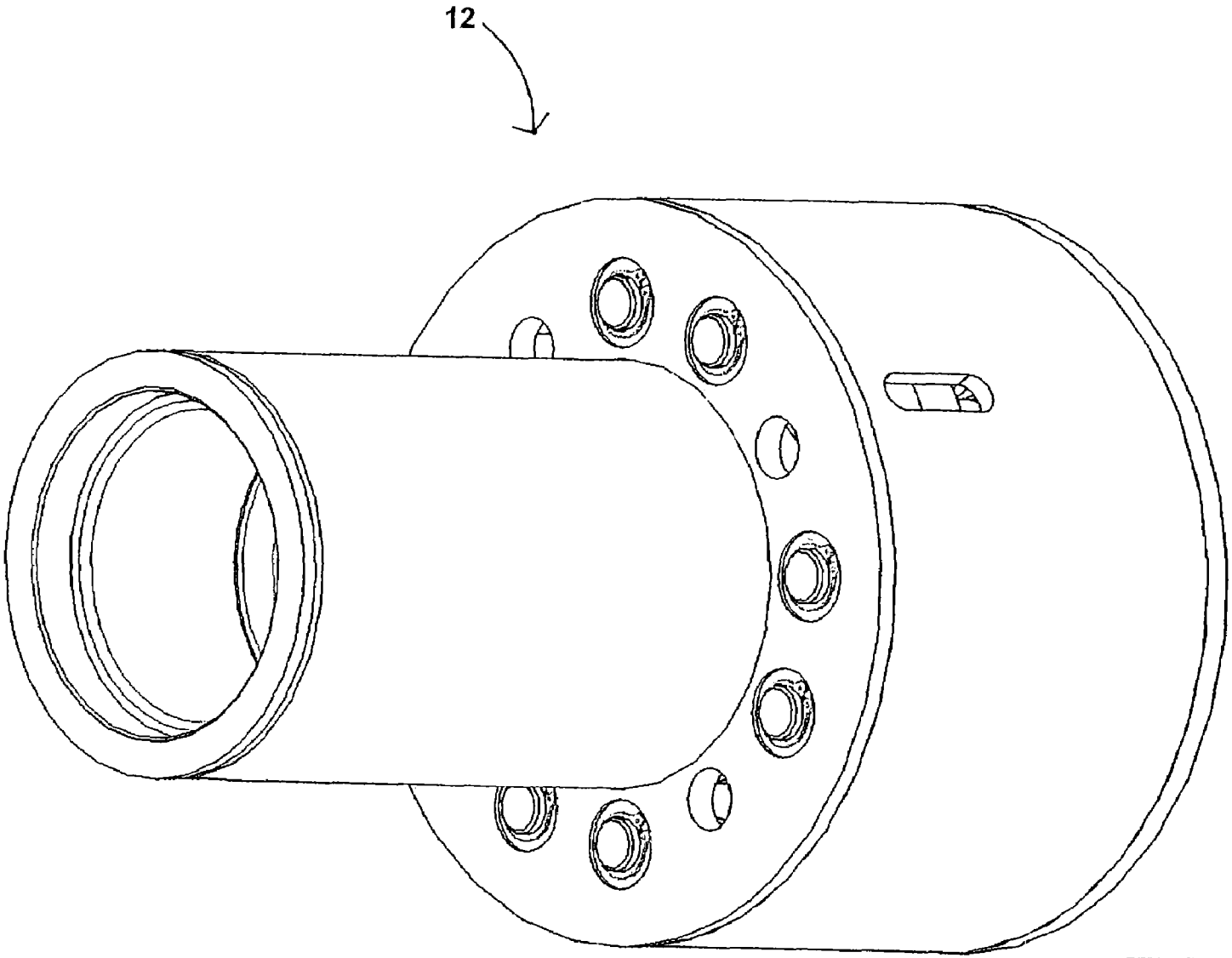
FIG. 14 is a side perspective view of the integral packing unit of FIG. 12 shown from a yet another perspective.

FIG. 12 also shows a packing wear monitor, in this instance a viewing port 48 though the side wall of the large cylinder 42 that reveals the linear travel position of a compression plate located within the housing, which indicates the wear level of the packing material housed within the packing unit 12. FIG. 13 is a side perspective view of the integral packing unit 12 shown from a different perspective. This view shows the set screws 30, the retention bolts 32, and the viewing port 48 from a better vantage point This view also shows portions of two compression springs 50 forming part of the compression unit housed within the larger cylinder 42. FIG. 14 is a side perspective view of the integral packing unit 12 from a yet another perspective.

Figure 15:
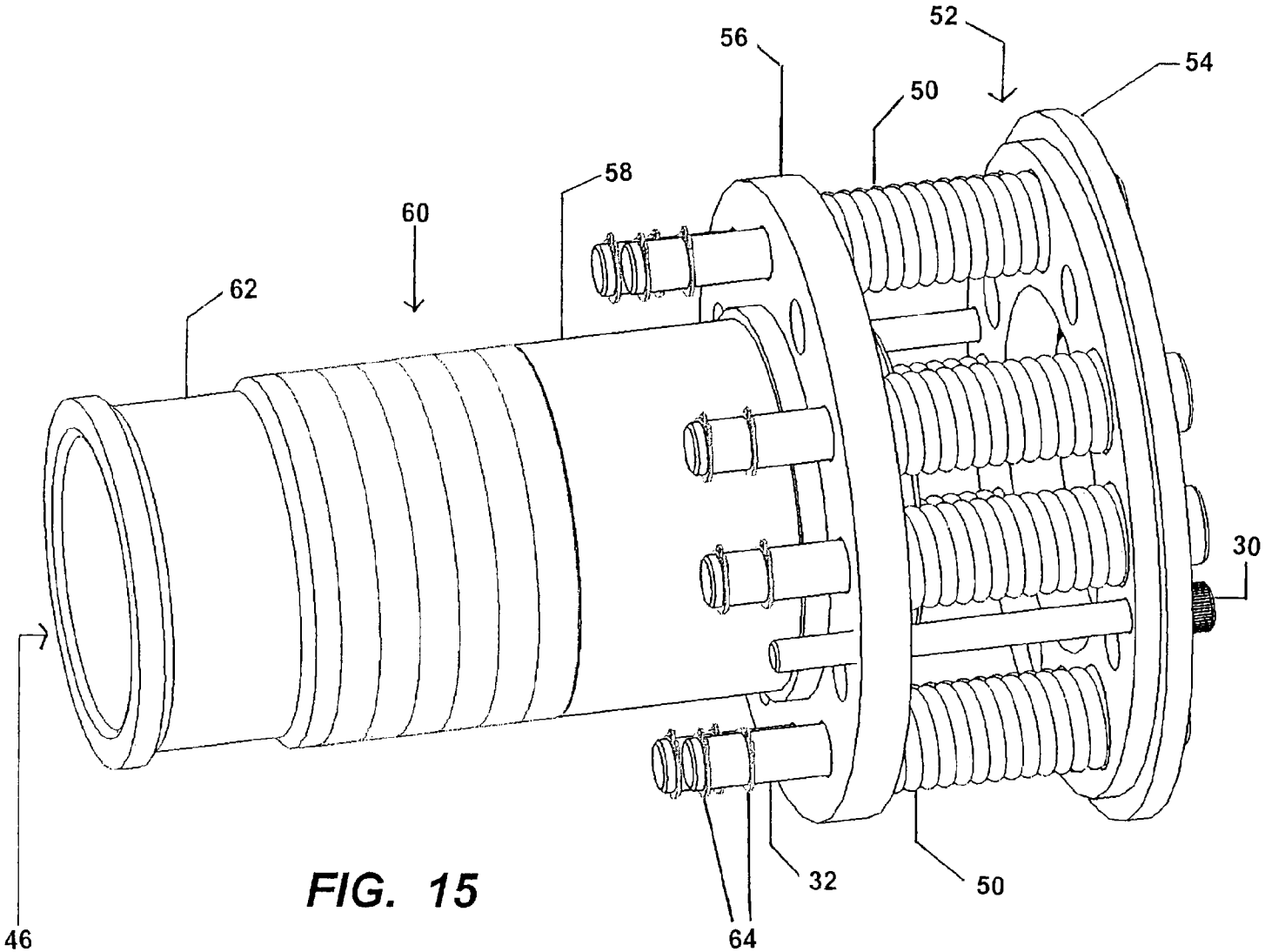
FIG. 15 is a side perspective view of the integral packing unit of FIG. 12 with the outer housing removed to reveal the internal components of the packing unit.

FIG. 15 is a side perspective view of the integral packing unit 12 with the outer housing 40 removed to reveal the internal components of the packing unit, which include a compression unit 52 that, in turn, includes a number of coil springs 50 (in this embodiment the number of coil springs is eight) located between a first compression plate 54 and a second compression plate 56. In this embodiment, one retention bolt 32 passes longitudinally through the center of each coil spring 50. The compression unit 52 is housed within the larger cylinder 42 and is coupled to a plunger 58 that extends into the smaller cylinder 44. The smaller cylinder also houses a number of concentric packing rings 60 positioned between the plunger 58 and a bushing 62, typically milled form bronze, that extends between the packing rings 60 and the end of the smaller cylinder 44. Bronze is the preferred material for the bushing 62 because bronze resists galling with the steel of the steam tube and functions well as a low friction bearing. It should be appreciated that the bushing 62 is removed and installed along with the integral packing unit 12, which makes it easy to replace the bushing when needed.

Thus, the packing rings 60 are positioned so that they are captured on the steam tube when the steam tube is received through the cylindrical opening 46. The packing rings 60 are also positioned for compression between the plunger 58 and the bushing 62 when the detent mechanism, in this case the set screws 30 (only one set screw is shown in FIG. 15), are screwed out sufficiently to be inactive. In particular, the illustrated set screw 30 typically includes a head that does not pass through the first compression plate 54 and a threaded shaft that passes though without engaging the first compression plate. The shaft of the set screw 30 threadably engages the second compression plate 56 so that the set screw can be screwed into the second compression plate to compress the coil springs 50 and unload the packing rings 60.

In this position, the detent mechanism formed by the set screws 30 is said to be "active" in that the detent mechanism is opposing the compression force of the springs 50. The set screws 30 can also be screwed out of the second compression plate 56 sufficiently to allow the compression unit to load the packing rings 60. In this position, the detent mechanism is said to be "inactive." In practice, the set screws 30 are typically removed completely from the packing unit 12 once the unit has been installed in its operative position on the sootblower 10. FIG. 15 also shows a number of retention clips 64 that hold the retention bolts 32 in place on the housing 40 so that the packing unit 12 does not fly apart when the set screws 30 are removed.

Figure 16:
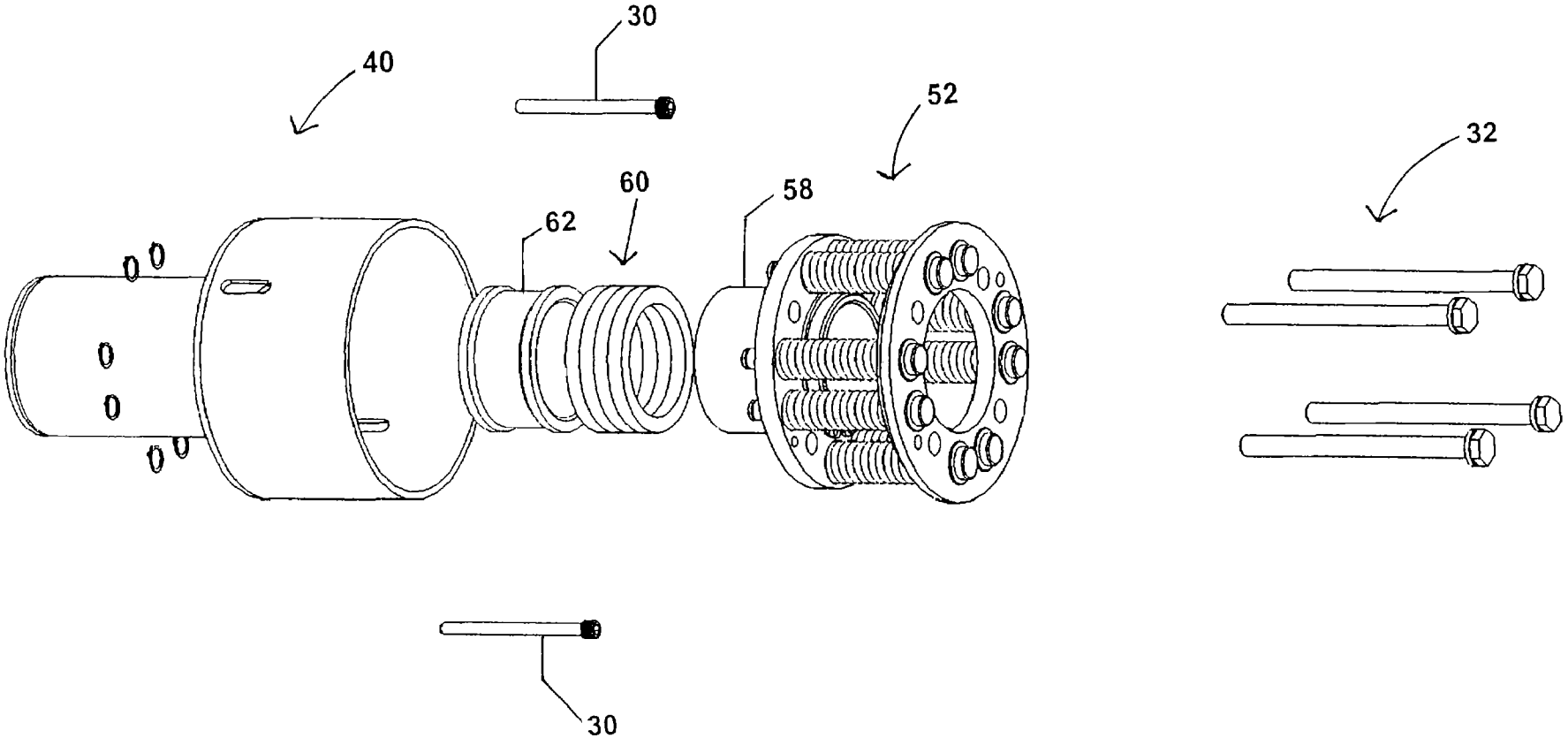
FIG. 16 is an exploded side perspective view of the integral packing unit.
Figure 17:
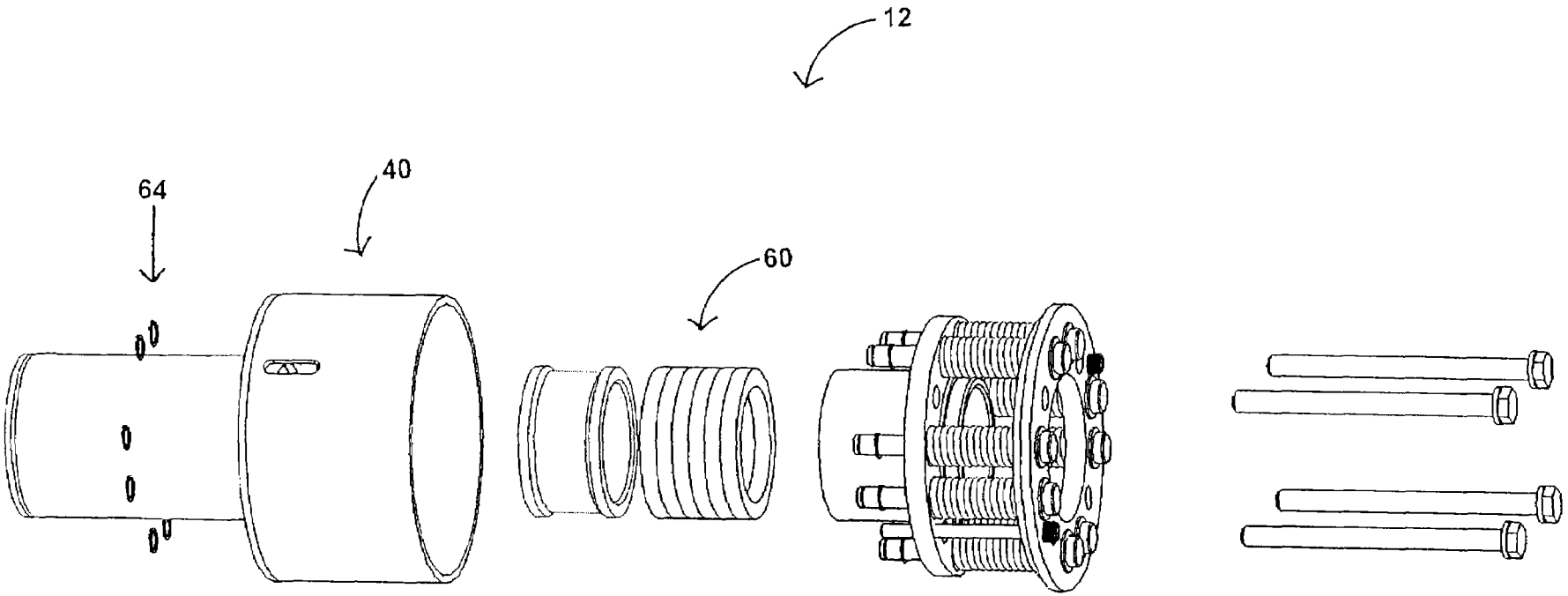
FIG. 17 is an exploded side perspective view of the integral packing unit of FIG. 16 shown from a different perspective.
Figure 18:
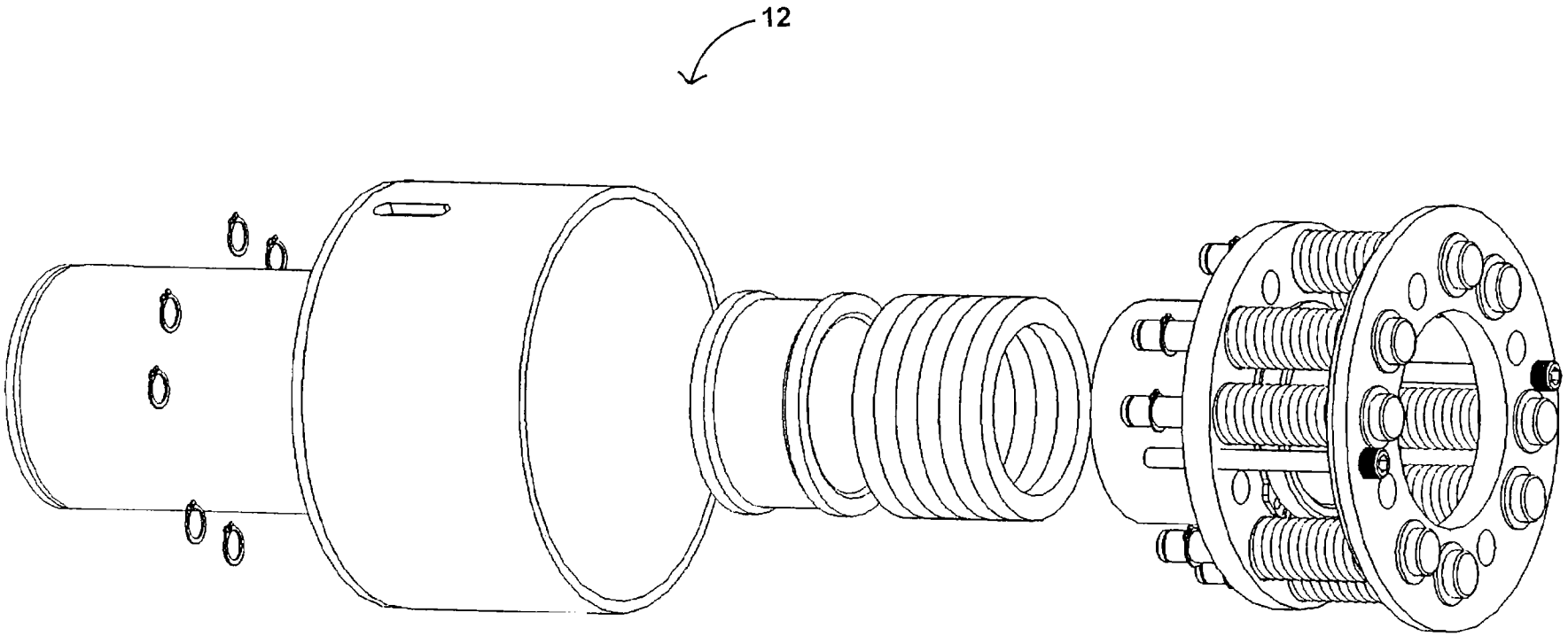
FIG. 18 is an exploded side perspective view of the integral packing unit of FIG. 16 shown from a yet another perspective.

FIG. 16 is an exploded side perspective view of the integral packing unit 12. It will be appreciated that the unit can be easily disassembled to replace spent packing rings with new packing rings 60 by installing and screwing in the set screws 30 to the active position, and then removing the outer retention clips 64 and the retention bolts 32. New packing rings 60 can then be installed and the packing unit 12 can be reassembled and reinstalled intact on the sootblower 10. Once so installed, the set screws 30 are deactivated (and typically removed entirely) to load the packing rings 60, and the sootblower is once again ready for service. FIG. 17 and FIG. 18 are exploded side perspective views of the integral packing unit 12 shown from different perspectives.

All of the following parameters are for a typical packing unit 12 as shown and described with reference to FIGS. 1-18. These particular parameters may be varied for particular applications. The outer housing 40 is manufactured from steel approximately 0.160" [4 mm] thick and the bushing 62 is milled from bronze and approximately ⅜" [19 mm] thick. The larger cylinder 42 has an outer diameter of 6.75" [17.2 cm] with a wall thickness of 0.188" [4.8 mm]. The smaller cylinder 44 has an outer diameter of 3.859" [9.8 cm] an inner diameter of 3.543" [9.0 m]. The plunger 58 has an outer dimension of 3.531" [8.97 cm] and an inner dimension of 2.807" [7.13 cm]. The upper and lower compression plates 54, 56 are approximately ½" [1.27 cm] thick and manufactured from steel. The packing rings 60 are manufactured to the customer's specifications from GRAPHOIL™ manufactured by Union Carbide. In this particular embodiment, the packing rings have an outer dimension of 3.543" [9.0 cm] and an inner dimension 2.755" [7.0 cm]. Four packing rings of this configuration are typically installed side-by-side in the packing unit 12. The coil springs 50 of the compression unit 52 have an outer dimension of 0.975" [2.45 cm], a free length of 4"[10.16 cm], and a spring constant of 132.8 lbs/in [23.72 kg/cm]. Wire material is 0.162" [4 mm] diameter music wire. The remaining specifications of the packing unit 12, such as bolt sized and patterns, are design details within the ken of one of skill in the mechanical arts.

Figure 19:
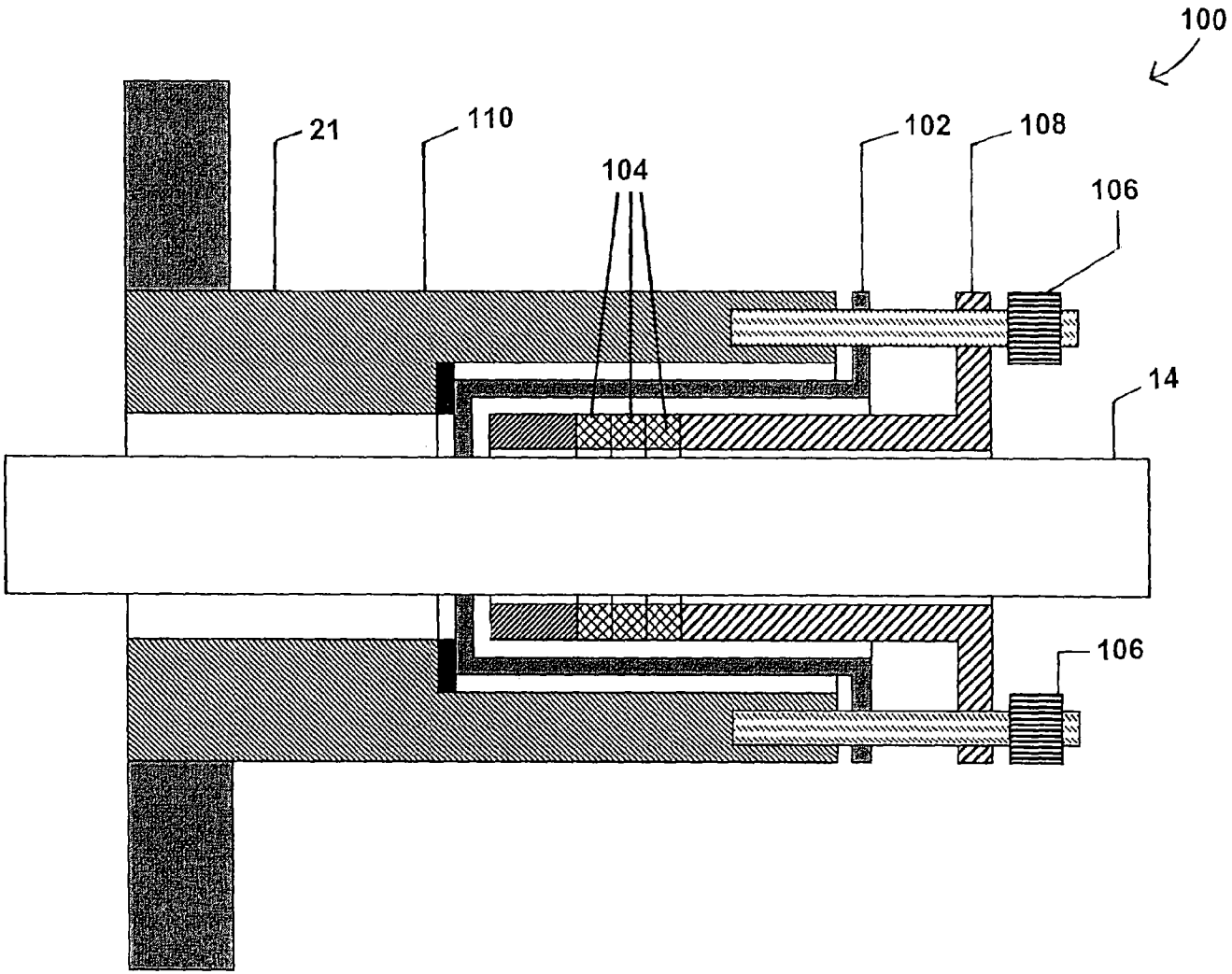
FIG. 19 is an side view of an alternative embodiment of the invention including an removable stuffing box and packing material.

FIG. 19 is an side view of an alternative embodiment 100 of the invention including an removable stuffing box 102 that contains a packing material, in this illustration three packing rings 104. The stuffing box 102 containing the packing rings 104 is bolted to the spindle 21 between the spindle and the steam tube 14 using any suitable bolts 106. The stuffing box 102 is cylindrical and surrounds the steam tube with the packing rings 104 captured o the steam tube 14, as in the previously described embodiment. The embodiment 100 also includes a plunger 108 located between the heads of the bolts 106 and the packing rings 104 so that the packing rings are located between the plunger and a bushing 110, which is located between the packing rings and the end of the stuffing box 102. Thus, the packing rings 104 may be loaded on an as-needed basis by manually tightening the bolts 106 to compress the packing rings between the plunger 108 and the bushing 110. Of course, springs could be included between the heads of the bolts 106 and the plunger 108 to provide live loading. The spent packing is replace by removing the bolts 106, which allows the stuffing box 102 with the spend packing rings 104 to be removed intact. New packing rings can then by easily installed, and the stuffing box 102 can be installed once again in its operative position between the spindle 21 and the steam tube 14. This particular embodiment represents a simple version of the invention that still achieves the benefits of a removable packing housing an packing material unit.

In view of the foregoing, it will be appreciated that present invention provides significant improvements in packing systems for sootblowers and that numerous changes may be made therein without departing from the spirit and scope of the invention as defined by the following claims.

The invention claimed is:

1. An integral and removable packing unit, comprising:

a housing for removably holding a sacrificial packing material configured to form a steam seal between a sootblower steam tube and lance spindle when the packing unit is installed in an operative position in association with the steam tube and the spindle and the packing material is loaded by applying compression to the packing material; and wherein the housing and packing material comprise an integral unit constructed so as to be installed to and removed from the stream tube and spindle with the packing material held intact within the housing.

2. The packing unit of claim 1, further comprising a compression unit for compressing the packing material to tighten the seal between steam tube and lance spindle when the packing unit is installed in the operative position.

3. The packing unit of claim 1, further comprising a detent mechanism for unloading the packing material to facilitate installing the packing unit on, and removing the packing unit from, the operative position.

4. The packing unit of claim 3, further comprising a compression unit comprising one or more coil springs located between first and second compression plates.

5. The packing unit of claim 4, wherein:

the packing unit defines a cylindrical opening for receiving the steam tube, and the packing material comprises a series of equally-sized, concentric, sacrificial packing rings having an inner dimension approximately equal to an outer dimension of the steam tube and an outer dimension approximately equal to an inner dimension of the housing.

6. The packing unit of claim 5, wherein the compression unit comprises a plurality of coil springs located around the cylindrical opening.

7. The packing unit of claim 6, wherein the detent mechanism comprises one or more set screws that threadably engage at least one of the compression plates to compress the coil springs and thereby unload the packing material.

8. The packing unit of claim 1, further comprising a packing wear monitor.

9. The packing unit of claim 8, further comprising a the compression unit comprises one or more coil springs located between first and second compression plates; and wherein the packing wear monitor comprises a viewing port revealing the linear travel position of the second compression plate.

10. The packing unit of claim 3, wherein the packing material is captured on the steam tube and compressed by the compression unit when the packing unit is in the operative position and the detent mechanism is inactive.

11. The packing unit of claim 3, wherein the packing material is captured on the steam tube and compressed between an internal bushing and a plunger coupled to the second compression plate when the packing unit is in the operative position and the detent mechanism is inactive.

12. An integral and removable packing unit, comprising:

a housing configured to be removably installed in an operative position in association with a sootblower steam tube and lance spindle with the steam tube passing through a cylindrical opening defined by the packing unit;

a plurality of concentric, equally-sized, sacrificial packing rings captured on the steam tube and configured to form a steam seal between the spindle and the steam tube when the packing unit is installed in an operative position and the packing material is loaded by a compression unit; and wherein the housing, packing rings and compression unit comprise an integral unit constructed so as to be installed to and removed from the stream tube and spindle with the packing material held intact within the housing.

13. The packing unit of claim 12, wherein the compression unit is located within the housing.

14. The packing unit of claim 13, further comprising a detent mechanism for unloading the packing material to facilitate installing the packing unit on, and removing the packing unit from, the operative position.

15. The packing unit of claim 14, wherein the compression unit comprises one or more coil springs located between first and second compression plates.

16. The packing unit of claim 15, wherein the detent mechanism comprises one or more set screws that threadably engage at least one of the compression plates to compress the coil springs and thereby unload the packing material.

17. The packing unit of claim 16, further comprising a packing wear monitor including a viewing port revealing the linear travel position of the second compression plate.

18. A sootblower comprising:

a steam tube;

a lance tube telescopically received on the steam tube and having an associated lance spindle;

a housing for removably holding a sacrificial packing material configured to form a steam seal between the steam tube and the lance spindle when the packing unit is installed in an operative position and the packing material is loaded by applying compression to the packing material; and wherein the housing and packing material comprise an integral unit constructed so as to be installed to and removed from the stream tube and spindle with the packing material held intact within the housing.

19. The sootblower of claim 18, further comprising a compression unit for compressing the packing material to tighten the seal between steam tube and lance spindle when the packing unit is installed in the operative position.

20. The sootblower of claim 19, further comprising a detent mechanism for unloading the packing material to facilitate installing the packing unit on, and removing the packing unit from, the operative position.

21. The sootblower of claim 20, wherein the compression unit comprises one or more coil springs located between first and second compression plates.

22. The sootblower of claim 19, wherein the detent mechanism comprises one or more set screws that threadably engage at least one of the compression plates to compress the coil springs and thereby unload the packing material.

23. The sootblower of claim 18, wherein the packing material is sacrificial, further comprising a packing wear monitor.

24. The sootblower of claim 23, further comprising a packing wear monitor.

* * * * *